United States Patent [19]

Strobel

[11] Patent Number: 5,001,792

[45] Date of Patent: Mar. 26, 1991

[54] DOUBLE WALL MATTRESS FOR WATERBEDS

[76] Inventor: Mark J. Strobel, 3131 Industrial Parkway, Jeffersonville, Ind. 47130

[21] Appl. No.: 495,855

[22] Filed: Mar. 19, 1990

[51] Int. Cl.[5] ..... A47C 27/10

[52] U.S. Cl. ..... 5/451; 5/449

[58] Field of Search ..... 5/451, 452, 450, 449, 5/422, 441

[56] References Cited

U.S. PATENT DOCUMENTS

| | | | |
|---|---|---|---|
| 4,149,286 | 4/1979 | Fogel | 5/451 |
| 4,168,555 | 9/1979 | Benjamin | 5/452 |
| 4,479,275 | 10/1984 | Fraige | 5/451 |
| 4,558,476 | 12/1985 | Linder | 5/451 |
| 4,638,518 | 1/1987 | Barbulla | 5/451 |
| 4,670,923 | 6/1987 | Gabriel et al. | 5/455 |
| 4,724,560 | 2/1988 | Christie | 5/451 |

FOREIGN PATENT DOCUMENTS

| | | | |
|---|---|---|---|
| 608951 | 2/1979 | Switzerland | 5/451 |

OTHER PUBLICATIONS

"Kuss" An Ad for the Morning Flower Mattress Kuss Corp., 1331 Broad Ave., Findlay, OH 45840.

*Primary Examiner*—Alexander Grosz

*Attorney, Agent, or Firm*—James B. Middleton

[57] ABSTRACT

A waterbed mattress is formed to include an inner waterproof bladder and an outer waterproof bladder. The two bladders are sealed together only at the fill valve for the inner bladder, so the rest of the two bladders are independent of each other; or, the bladders may be completely unconnected. The sleeping surface of the mattress may be embossed; and, preferably, both the inner and outer bladders will be embossed. The outer bladder may be of transparent material so that leakage of the inner bladder can be easily detected.

3 Claims, 2 Drawing Sheets

Fig_1
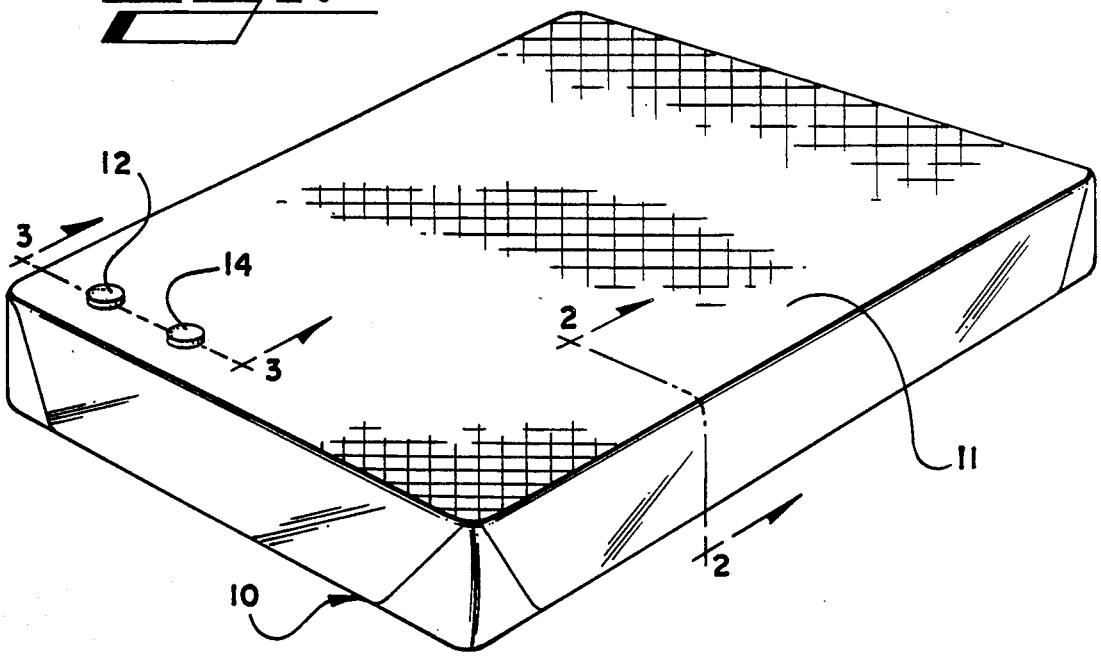
Fig_2
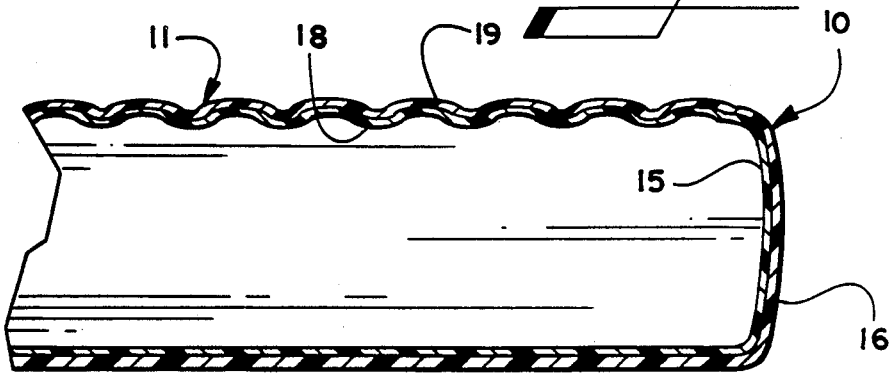
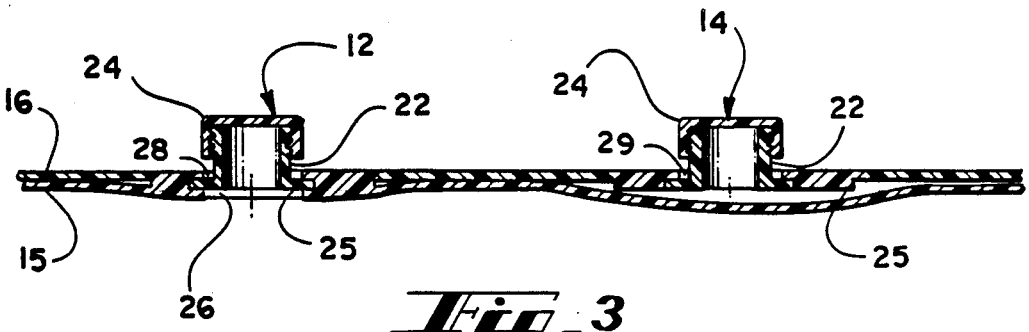
Fig_3

DOUBLE WALL MATTRESS FOR WATERBEDS

INFORMATION DISCLOSURE STATEMENT

Waterbeds have achieved a place in society as a standard alternative to the conventional innerspring mattress. Nevertheless, there are some people who refuse to purchase a waterbed because of the fear of leakage of the mattress. It is an industry standard, and a law in some jurisdictions, for every waterbed to include a waterproof liner that will catch and retain water in the event the mattress does leak. In spite of these safeguards, some people still fear the leakage of the waterbed mattress.

It is true that waterbed mattresses do sometimes leak. Even though good quality materials are used, and care is taken in manufacture, mattresses sometimes leak. One of the reasons for leakage after some use is the fact that the mattresses are usually made of vinyl sheet material, the sheet material being heat sealed to make the mattress. The heating of the material for seaming causes some degradation of the vinyl, so the probability for leaks at the seams is somewhat greater than at other parts of the material. In an effort to guarantee good quality, some states have required a minimum thickness of 20 mils (.020") for the sheet material from which waterbed mattresses are made. Even so, some mattresses will eventually leak, and more probably at one of the seams.

One effort at resolving the leakage problem has been to seal two sheets of vinyl together, forming effectively a 40 mil sheet. This has not truly solved the problem because there is still a single seam, and when that seam leaks, the mattress leaks. Another effort to solve the problem involves the use of a self-sealing mattress. This effort has never been successful in that the coating does not remain in contact with the vinyl in order to be able to seal holes in the vinyl.

SUMMARY OF THE INVENTION

This invention relates generally to waterbed mattresses, and is more particularly concerned with a waterbed mattress having a double wall throughout the mattress.

The present invention provides a waterbed mattress having a double wall to lower the likelihood of leakage from the mattress. The mattress of the present invention includes one waterproof bladder enclosed within a second waterproof bladder. In the preferred embodiment of the invention the two bladders are connected together only at the fill valve for the inner bladder. Means is provided to remove air from the outer bladder to prevent air pockets between the two bladders.

BRIEF DESCRIPTION OF THE DRAWINGS

These and other features and advantages of the present invention will become apparent from consideration of the following specification when taken in conjunction with the accompanying drawings in which:

FIG. 1 is a perspective view of a waterbed mattress made in accordance with the present invention;

FIG. 2 is an enlarged cross-sectional view taken along the line 2—2 in FIG. 1;

FIG. 3 is an enlarged cross-sectional view taken along the line 3—3 in FIG. 1;

Detailed Description of the Embodiment

Figure 4:
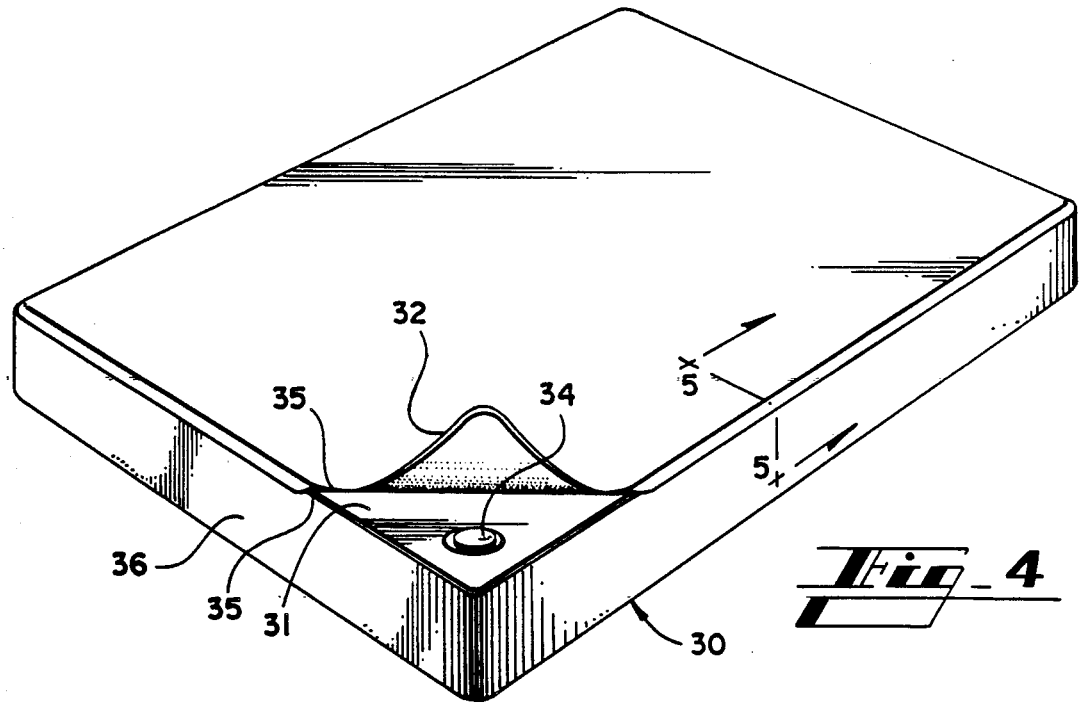
FIG. 4 is a perspective view of another embodiment of the present invention; and, FIG. 5 is an enlarged cross-sectional view taken along the line 5—5 in FIG. 4.

Referring now more particularly to the drawings, and to those embodiments of the invention here chosen by way of illustration, FIG. 1 shows a waterbed mattress generally designated at 10, and having a sleeping surface 11. The surface 11 includes two fill holes designated at 12 and 14 which will be discussed in more detail hereinafter.

It will be observed that the bladder 10 is indicated as transparent. It is contemplated that the outer bladder of the two bladders will be transparent, and the inner bladder translucent or opaque. This will allow the user to inspect the mattress at any time and determine if the inner bladder is leaking. Obviously, both inner and outer bladders may be opaque, or both may be transparent, or the inner bladder may be transparent while the outer bladder is opaque. Any of these combinations will provide a usable mattress, but a transparent outer bladder is preferable for the monitoring allowed.

The mattress in FIG. 1 is indicated as having a textured sleeping surface 11, and this is also shown in FIG. 2. It will be understood by those skilled in the art that mattresses typically include extra sheet material in the sleeping surface 11 to prevent the surface from feeling taut. The surface 11 is sometimes textured, or embossed, to give the material a neater appearance. The mattress of the present invention may or may not utilize the embossed surface, this being a matter of choice. Furthermore, since there are two bladders in the mattress of the present invention, one or both of the bladders may be embossed as desired. It will be recognized, however, that most of the reason for embossing is aesthetics; and, if the outer bladder is transparent, the inner bladder should be embossed because it will be visible.

As illustrated in FIG. 2 of the drawings, the mattress 10 includes an inner bladder 15 and an outer bladder 16. The sleeping surface 11 is embossed, and it will be seen that both the surface 18 of the inner bladder 15 and the surface 19 of the outer bladder are embossed. For convenience of illustration, the convolutions of the two surfaces 18 and 19 precisely correspond. It will be understood however that the two surfaces may be randomly placed with respect to each other. Random placement will not detract from the function of the mattress.

With continued attention to FIG. 2 of the drawings, it is contemplated that both the inner bladder 15 and the outer bladder 16 will be formed from sheets of vinyl (polyvinyl chloride) having a thickness of 20 mils. This is desirable since the equipment for heat sealing the vinyl sheets during manufacture is set to seal the 20 mil vinyl effectively, and changes would have to be made if the type of material and/or the thickness of the material is changed. It should nevertheless be understood that the double wall mattress of the present invention will allow one to utilize a 20 mil vinyl as the outer bladder 16 to meet the industry and legal requirements of waterbeds, and to utilize a different material for the inner bladder 15.

It is well known that there are several plastic sheets that are superior to vinyl in strength, processability, etc. Thus, a different material might be used for the inner bladder 15. One might select a material with greater strength, such as a linear low density polyethylene, and use the material in a very thin gauge. Similarly, a polyvinylidene chloride sheet or a polyethylene terephthalate sheet may be used, or any other flexible, thermoplastic sheet. The inner bladder could thereby provide a superior resistance to leakage, while the outer bladder would provide the familiar feel and appearance. On the other hand, a very inexpensive inner bladder may be used, so that the inner bladder will provide just a little additional security. For this purpose, a thin vinyl sheet may be used, or a medium density polyethylene or the like. Thus, many different combinations may be selected by the person skilled in the art.

Any waterbed mattress must have a means for filling the mattress. With the double wall mattress of the present invention it will be recognized that means must be provided for filling the inner bladder. Some access means is also required for the outer bladder, both to remove air therefrom, and to empty the outer bladder in the event the inner bladder does leak.

Looking at FIG. 3 of the drawings, access means are indicated at 12 and 14. Those skilled in the art will understand that access means, or fill valves, are well known in the art and are readily available with the neck 22 receiving a cap 24 on its outer end. The inner end of the neck 22 has a flange 25 extending therefrom, and this flange 25 is the means for sealing the valve to the bladder. The two fill valves 12 and 14 are alike, and only one valve will be described in detail. The same reference numerals are used on both valves shown.

The fill valve 12 is for filling the inner bladder 15, and it will be seen that the inner bladder 15 defines a hole 26. The hole 26 is aligned with a hole 28 in the outer bladder 16; and, the flange 25 of the valve 20 is inserted between the inner bladder 15 and the outer bladder 16, with the neck 22 of the valve 12 aligned with the holes 26 and 28. In this position, the three layers of material are sealed together. While the valve 12 could be sealed to the inner bladder 15 only, there would be a chance that the neck would slip through the hole 28 and cause some difficulty in filling the mattress. By sealing the two bladders together at the fill valve, the two bladders are fixed in relation to each other while allowing great freedom in individual movement throughout the mattress.

Nevertheless, if it is preferred to have only the one hole in the bladders, the valve 14 could be a larger valve that would enclose the valve 12. Such structure is contemplated as part of the present invention.

The fill valve, or access valve, 14, has its neck 22 extending through a hole 29 in the outer bladder 16. The inner bladder 15 is illustrated as removed from the valve 14, but it should be understood that this is only for the sake of clarity in the drawing. In use, the inner bladder 15 will lie fully against the outer bladder 16 if all the air has been bled from the outer bladder 16. Removing the air from the outer bladder is the primary purpose of the valve 14, though the valve 14 also allows any needed access to the outer bladder 16.

With the foregoing description in mind, it will be understood that manufacture of the double wall mattress of the present invention will proceed in a manner very similar to the manufacture of a single wall mattress. It is contemplated that the blanks for the two bladders will be cut to the same size. While the inner bladder 15 may theoretically be smaller, the difference is only a few thousandths of an inch, and the elasticity of the material renders the difference practically unnoticeable.

The next step towards manufacture is to form the corners of the bladder. For the double wall mattress, one must form eight corners instead of four, but the steps are otherwise the same. Next, one seals the principal seams at the head and foot of the mattress. The inner bladder 15 will be seamed first, then the outer bladder 16. The side seams are then made, again sealing the inner bladder, then the outer bladder.

Sealing of the seams of waterbed mattresses is most commonly effected through the use of radio frequency (RF) energy. The technique requires a metal member to be on one side of the material, while the RF energy is directed against the other side. As a result, a metal bar is placed into the mattress for sealing, and this bar must be removed. For the final seam, the bar can be removed through the access valve 14.

Attention is directed to FIG. 4 of the drawings which shows another arrangement for a double wall mattress. The mattress in FIG. 4 includes an outer bladder 30 and an inner bladder 31. The upper surface 32 of the outer bladder 30 is opened to reveal the inner bladder 31 and its fill valve 34. It will be understood that the fill valve 34 may be a completely conventional valve.

In this embodiment of the invention, the inner bladder 31 may be a conventional waterbed mattress, the conventional mattress 31 being enclosed within an outer bladder, or covering, 30. As here illustrated, the outer bladder 30 includes the bottom portion 36 to receive the bladder 31, the bottom portion 36 having a bottom surface and upstanding walls. The bottom portion is closed by the top portion 32, which is the top surface of the mattress, attached by means of a closure member 35. It is contemplated that the closure member 35 will extend completely around the mattress so the top portion 32 is totally separable from the bottom portion 36 of the mattress, though of course the bladder 30 may open on one side, two sides or three sides if desired. It is important that the valve 34 of the inner bladder 31 be accessible through the closure 35, but the placement and extent are not otherwise of great importance.

Figure 5:
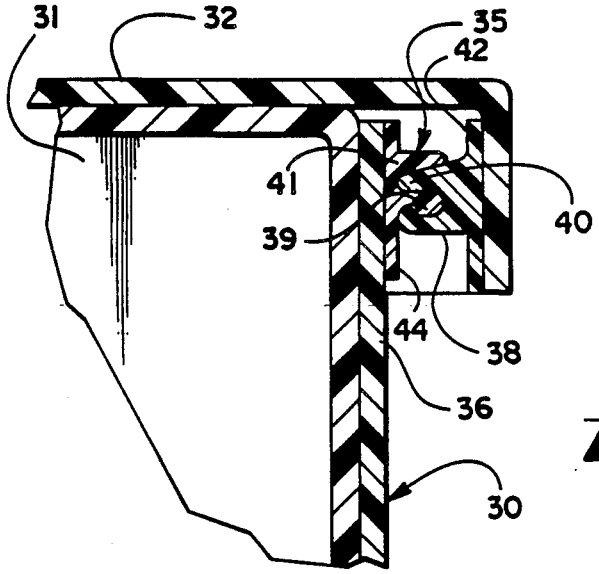

The closure 35 is shown in more detail in FIG. 5 of the drawings, and it will be seen that the closure member 35 is a conventional interlocking plastic zipper of a type well known in the converting art. The zipper includes opposed hook members 38 and 39 which lock together, assisted by guide, or aligning fingers 40 and 41. These members are fixed to bases 42 and 44 which are attached to the bottom and top portions of the bladder 30.

Those skilled in the art will realize that there are numerous forms of closure such as the zipper 35, and any such member will serve. Some zippers include two or more hook members such as the hook members 38 and 39 for a better hold, and guide fingers fit together to assure a fluid-tight seal. These and other features well known in the art may be selected as desired.

The present invention therefore provides a waterbed mattress that is more secure against leakage than prior art mattresses. While the prior art includes mattresses having two sheets of vinyl sealed together, then a mattress made from this double thickness, it will be recognized that all seams are unitary in such a mattress. Those skilled in the art will also realize that the vinyl sheet from which waterbeds are made is rather highly plasticized; and, any attachment to or lamination with such material is likely to promote plasticizer migration or leaching of the plasticizer. If the plasticizer is removed from the vinyl sheet, the sheet is very likely to crack and cause the mattress to leak. With the present invention, there are entirely separate seams for the inner and outer bladders. Since the seams are the most likely places for leaks to occur, there is the security of two seams rather than one. By making the outer bladder 16 of transparent material, one can monitor the mattress and easily determine if the inner bladder is leaking. Once the inner bladder has begun to leak, one may of course continue to use the mattress, relying on the outer bladder. Alternatively, the mattress can be drained, and the leak repaired. Even so, the repair will not be an emergency repair, but can be delayed until a convenient time.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. In a mattress for a waterbed, wherein said mattress includes a bladder for containing a quantity of water, and access means for filling and draining said bladder, the improvement wherein said mattress includes a first bladder for containing a quantity of water, and a second bladder for containing said first bladder, said first bladder being fully within said second bladder and completely filling said second bladder, and first access means for providing access to said first bladder for filling and draining said first bladder, and second access means for providing access to the interior of said second bladder, the arrangement being such that said first bladder provides support for a person lying on the mattress and said second bladder provides a second bladder to contain leakage from said first bladder, said first access means including a neck, and a flange on one end of said neck for fixing said neck to a bladder, said first bladder defining a hole therein aligned with said neck, said flange being disposed between said first bladder and said second bladder, the further improvement wherein said second access means includes a neck, and a flange on one end of said neck for fixing said neck to a bladder, said second bladder defining a hole therein receiving said neck therethrough, said flange being sealed to said second bladder around said neck, said second bladder defining a second hole therein aligned with said neck of said first access means, said neck of said first access means extending through said second hole in said second bladder, said flange of said first access means being sealed to both said first bladder and said second bladder so that said first bladder and said second bladder are retained in fixed relation to each other while said first bladder is free to conform to the interior of said second bladder.

2. In a mattress as claimed in claim 1, the further improvement wherein said second bladder is generally transparent for allowing monitoring of said first bladder.

3. In a mattress as claimed in claim 2, the improvement wherein at least one surface of said second bladder is embossed, and at least one surface of said first bladder is embossed.

* * * * *